United States Patent [19]

Graves et al.

[11] 3,982,681

[45] Sept. 28, 1976

[54] PAPERBOARD HOGSHEAD

[75] Inventors: Charles Berger Graves, Alton; Paul J. Richnak, Godfrey, both of Ill.; Robert M. Wilkinson, Florissant, Mo.; Robert G. Wright, Statesville, N.C.

[73] Assignee: Alton Box Board Company, Alton, Ill.

[22] Filed: Mar. 10, 1975

[21] Appl. No.: 556,791

[52] U.S. Cl. ..... 229/4.5; 220/65; 220/71; 220/76

[51] Int. Cl.[2] ..... B65D 3/00; B65D 25/14; B65D 25/34

[58] Field of Search ..... 229/4.5; 220/65, 71, 220/76

[56] References Cited

UNITED STATES PATENTS

| | | | |
|---|---|---|---|
| 51,352 | /1865 | Reutgen | 220/65 |
| 2,304,615 | 12/1942 | Wansker | 229/4.5 |
| 2,968,124 | 1/1961 | Coplen | 229/4.5 |
| 3,120,917 | 2/1964 | Smith | 229/4.5 |
| 3,397,829 | 8/1968 | Wilkins | 229/4.5 |

*Primary Examiner*—William Price
*Assistant Examiner*—Douglas B. Farrow
*Attorney, Agent, or Firm*—Paul M. Denk

[57] ABSTRACT

In a hogshead formed from convolutely wound paper tubes that are cut into complemental halves, reinforcing staves are adhered to the marginal cut edges of each tube moiety, and hinge members, comprising generally two part hinges, are secured to each stave with their turned ends embracing against the remote side edges of each stave to insure structural integrity for the hogshead particularly while the tobacco is being prized; the upper and lower interior edges of each tube half portion includes liners that are rigidly fastened thereto, while end closures having ring members that are arranged concentrically within the liners are fitted within the assembled hogshead to provide it with closure.

The staves may be formed from metal that is pressed to expose a series of pointed spikes that may insure the retention of each stave to the paperboard tube, and the hinge means may be designed to provide their partial insertion within said tubes halves to further insure the structural integrity of the hogshead during usage.

19 Claims, 20 Drawing Figures

PAPERBOARD HOGSHEAD

BACKGROUND OF THE INVENTION

This invention relates generally to containers, and more particularly pertains to a reinforced collapsible paperboard hogshead for use in the handling of tobacco.

As is well known in the tobacco trade, hogsheads have universally long been used as the means for supporting a large quantity of tobacco for shipment. In earlier days, such hogsheads were usually constructed from wooden staves that were generally assembled into the cylindrical configuration by means of straps, thereby undertaking the appearance of the standard wooden barrel. When in assembled form, these containers are disposed for holding an ample quantity of tobacco, generally after it has been cured, and hogsheads of this type may customarily support anywhere from 1000 to 1300 pounds of prized tobacco.

To hold this much weight of tobacco, in the hogshead container, requires its very dense compaction within the same, and as is also well known in the art, the concept of prizing, or pressing, a large quantity of the tobacco into the hogshead generally through use of a hydraulic press is the procedure frequently used. After such tobacco had been prized, which usually occured after its sale at an auction, such compacted quantity of tobacco, contained within its hogshead, would then be shipped to a distant location for its further processing into cigarettes, pipe tobacco, or the like, such type shipments not only being made domestically, but additionally to manufactures located abroad.

For the foregoing reasons, tobacco hogsheads generally are constructed into the circular form, since the heavy forces of the cutomarily employed hydraulic pressure, sometimes in excess of 10,000 pounds per square inch, as impressed upon the contained tobacco during prizing, would have a tendency to cause bulging and distorting of its container if it was in any shape other than the circular form. Older style tobacco hogsheads constructed from a plurality of wooden staves that are linked together into the circular form are shown in the earlier U.S. Pat. No. 1,477,105, in addition to U.S. Pat. No. 2,514,829.

Of more recent vintage has been the construction of tobacco hogsheads from wound paperboard material, generally wound into the circular form, and the U.S. Pat. No. 3,291,362 discloses one such hogshead being formed of fiberboard, although the discussions in this patent describe the use of a cylindrical paper body for a hogshead, at the time of the development of the therein disclosed fiberboard hogshead, only suggested paper type containers in the proposed form.

The patent to Dunlap, U.S. Pat. No. 3,064,870, discloses a collapsible container being formed from spirally wound paper tubes for use as a tobacco hogshead. Spirally wound tubes of this nature, while being an improvement over the aforesaid type of fiberboard formed hogshead yet contains inherent drawbacks in that spiral wound tubes generally are of much lesser strength than convolutely would tubes, and furthermore, their configuration is limited specifically to the circular form due to the impossibility of spirally winding such tubes to any other shape, such as the noncircular configuration.

The present invention comprises an improvement over these earlier style of hogsheads, as either formed from wooden staves or spirally wound paperboard, and essentially incorporates the use of convolutely wound paper tubes manufactured to a thickness that allows for their structural integrity even when subjected to the excessive pressures of tobacco prizing, but which can be collapsed into its separable components as when it is desired to return the same to its site of use for further reusage.

The principal object of this invention is to provide a convolutely wound paper hogshead that is of sufficient strength to be used in conjunction with tobacco prizing, but yet contains reinforcing members that further insure against its failure, and even allows for its collapse for reshipment and eventual reuse.

Another object of this invention is the provision of a convolutely wound paperboard hogshead that contains strategically located reinforcing members that insure repeated usage of its various components for tobacco prizing, storage, and shipment.

A further object of this invention is to provide a unique hinge means that cooperates with the reinforcing means of a paper wound hogshead, and which allows for the quick dismantling of its various components for removal of any transported tobacco.

An additional object of this invention is to provide a paper wound tube that is cut into separable half portions of a circular hogshead, which components can subsequently be collapsed for return shipment in a minimum of space.

An additional object of this invention is to provide a unique reinforcing member or stave that contains its own integral fastening means to provide for reinforcement of the hogshead at the location of its line of separation, and there provide the necessary structure for cooperating with the hinge means for retaining the hogshead together, particularly during tobacco prizing.

A further object of the invention is to provide a unique hinge means that can cooperate with either the reinforcing stave, or insert within a slot of the paperboard body of the hogshead itself so as to insure retention of its separable halves together particularly during tobacco prizing.

Another feature of this invention is to provide a hogshead made up of separable components that may be easily assembled for quick usage, but yet promptly disassembled upon reaching the location where its contained tobacco is to be used.

A further object of the invention is to provide a tobacco hogshead formed from convolutely wound kraft paper and which therefore can be constructed into various shapes, in cross section, other than the circular form.

These and other objects will become more apparent to those skilled in the art upon a reading of the summary of this invention, in addition to reviewing the description of the preferred embodiment in view of its drawings.

SUMMARY OF THE INVENTION

The essence of this invention is the formation of convolutely wound paper tubes, being wound from paper stock or kraft paper of the usual type normally employed in the formation of convolutely wound tubes, and which paper like material employed in the formation of the tube blank of the invention may be in the vicinity of 0.010 inches thick, and ordinarily not over 0.025 inch thickness, although, other thickness depending upon the strength desired may be used. As is well known in the trade, paper material of this type is fed onto a collapsible mandrel in a direction that is essentially perpendicular with respect to the longitudinal axis of said mandrel, having just previously applied to its web of paper sufficient adhesive to allow for the adherence of the plies of wound paper together. In this invention, the wound paper tube, since it is convolutely wound, may preferably be formed into the circular configuration, but it is just as likely that the invention may entertain the noncircular forms of paper cylinders. In any event, the paper tubes formed in this manner are cut into lengths approximating 48 inches, and each cut cylinder is then once again severed into two complemental half portions, or hald cylinders, for purposes to be hereinafter described.

Each half cylinder, then, includes a stave that is adhered, usually by nailing or stapling or other form of fastening means, just proximate the cut marginal edge of the half tube portion, so that when the tube halves are brought together into the cylindrical form, a pair of staves from each half cylinder lie just adjacent to each other along the line of separation of said complemental tube halves. The staves may be formed of wood, but preferably have been designed of metal, which for the sake of convenience and expediting of assembly, include a series of punched out portions that form pointed spikes that may be driven directly into the surface of the paperboard tube for their firm adherence.

Proximate both the upper and lower interior edges of the assembled tube halves there is provided a liner, which in the preferred embodiment, may be formed of wood, or other paper tube of slightly less diameter, being firmly fixed thereto so as to remain securely in place. End closures are provided for both ends of the paper tube hogshead, and these end closures also include a circular member that has dimensions corresponding to the interior dimensions of the assembled papertube, or hogshead, and includes a ring member that is secured to one surface of the circular member, usually its exteriorly oriented surface, with said ring having an outside diameter only slightly less than the interior diameter of the aforesaid liners. Hence, the end closure, as for example the bottom end closure, may be inserted into the downward portion of the assembled hogshead, while the upper end closure will not be inserted until ample quantity of tobacco, in the amount and weight as previously described, has already been prized for compaction into the hogshead. At that time the upper end closure is free for insertion into the upper end of the hogshead and to be retained therein by means of its interiorly arranged liner securing the end closure therein.

Reinforcement of the tube half portions of the hogshead through the use of the staves, as previously described, has the further attribute of allowing for the convenient fixing and securement of hinge members to said staves, and the hogshead halves together, rigidly affixing the hogshead laterally into closure, and into the cylindrical form as shown herein. These hinges are generally designed into two parts, and which parts can be held together by means of a pin that inserts through the interdigitated portions of said hinge member. The other ends of the hinge parts include turned ends that are designed for hooking against the back or remote edge of their proximate stave so that as pressure is exerted upon the hogshead, as during tobacco prizing, these turned ends will tightly bind against the stave edges so as to further insure the reinforcement of the hogshead at this location and to further prevent its untimely pressured opening. As a further modification to the hinge means of this invention, the hogshead, and more particularly each tube moiety, may have apertures provided therethrough at the location of where the turned ends of the hinge means are disposed, with said hinge means being further designed having integral extensions that may project through the said apertures, and therein being once again turned to provide for their contiguity against an inner surface of the hogshead. In this manner, any pressure exerted upon the hogshead as during prizing not only is restrained from urging the tube half portions apart, as by means of the hinge means cooperation with the aforesaid staves, but that the two portions themselves add to the resistance against separation.

As is well known in the art concerning tobacco hogsheads, and their unique construction, so that they may be manipulated as desired for the purpose of inspecting their tobacco cargo contained therein, as during an auction, or when it is necessary to provide means for closing their upper ends, the present invention is uniquely designed to accommodate any such trade conduct. Paper tubes convolutely formed still have sufficient resiliency in them to allow their end to be slightly distorted and spread apart from their normally wound shape, so that upon removal of the pin from any one of the upper hinge members, its tube half portions at those locations may be bent or pulled outwardly so as to allow the contiguous end closure to achieve clearance and to be lifted therefrom away from its retaining liner, and likewise, the end closure may be inserted into its operative position under the reverse procedure as when it is desired to initiate transit of the tobacco laden hogshead.

BRIEF DECRIPTION OF THE DRAWINGS

In the drawings,

FIG. 1 provides a perspective view of a tobacco hogshead fabricated under the teaching of this invention;

FIG. 2 provides a front view of the tobacco hogshead of FIG. 1 showing its vertically arranged hinge members;

FIG. 3 provides a side view of the tobacco hogshead of this invention, showing the series of hinge members being arranged vertically along the side positioned cut margins of the two tube half portions assembled for forming the body of said hogshead;

FIG. 4 provides a top plan view of the hogshead of this invention, further showing its upper end closure in place;

FIG. 5 provides a top plan view of the hogshead of this invention with its upper end closure being removed;

FIG. 6 discloses an inside view of an end closure of the hogshead of this invention;

FIG. 7 provides a front view of a style of hinge member of this invention;

FIG. 8 provides a top view of the hinge member shown in FIG. 7;

FIG. 9 provides an exploded view of the various components forming the hogshead of this invention, with the left side of a tube half portion, in addition to its upper end closure, being sectionalized to disclose its interiorly arranged liner and ring member, respectively;

FIG. 10 discloses a front view of a modified form of metallic stave utilized in this invention;

FIG. 11 provides a side view of the stave shown in FIG. 10, further showing its pointed projections or spikes as formed integrally of the stave;

FIG. 12 provides a top view of the metallic stave of the invention as shown in FIG. 10;

FIG. 13 discloses a modified form of hinge member for use in holding the tube half portions together;

FIG. 14 provides a top view of the hinge member shown in FIG. 13;

FIG. 15 discloses one of the hinge parts of the hinge member disclosed in FIG. 13 as applied to its contiguous stave and inserted through an aperture provided through the wall of the proximate tube half portion;

FIG. 16 discloses a modification in the application of the metallic stave and its series of fastener means to the contiguous marginal cut edge of a tube half portion;

FIG. 17 discloses one part of a fastener means, or hinge part, having patterned apertures provided therethrough to accommodate the insertion of the pointed tabs of the metallic stave;

FIG. 18 discloses a top edge view of the metallic stave being inserted through the patterned apertures of a hinge part of the fastener means;

FIG. 19 provides a partial side view of an upper edge of the hogshead disclosing the means for removably fastening a liner to the inner upper edge of a tube half portion; and FIG. 20 provides a partial top view of an upper edge of the tube portion and liner disclosed in FIG. 19.

DESCRIPTION OF THE PREFERRED EMBODIMENT

Figure 1:
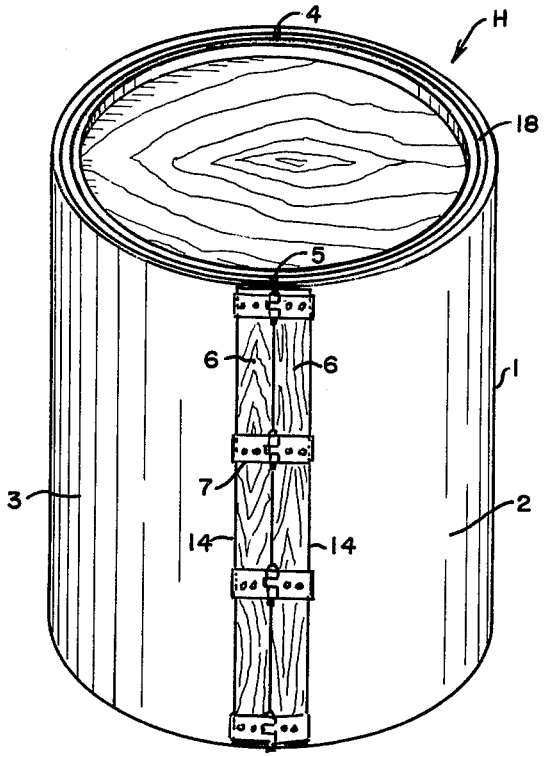
Figure 2:
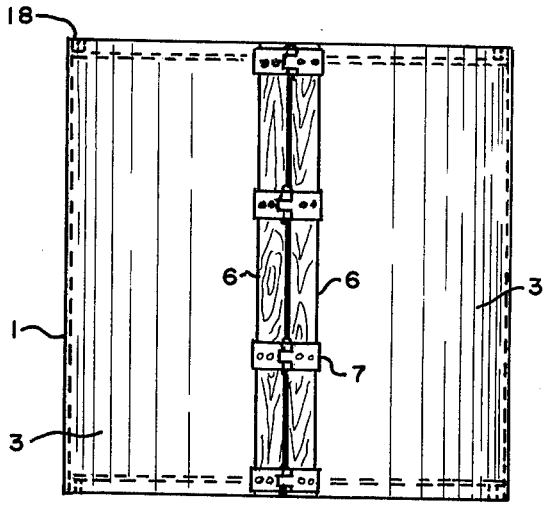

In referring to the drawings, and in particular FIGS. 1 through 4, there is shown the hogshead H of this invention and comprising a convolutely wound cylinder of paper being approximately forty-eight inches in heighth, forty-seven inches in diameter, and having a paperboard thickness of approximately 0.250 inches. These dimensions are quite standard for the design of hogsheads as heretofore utilized in the tobacco industry, but obviously, other dimensions may equally apply in the formation of a paperboard hogshead constructed under the teachings of this invention. These dimensions are set forth simply to provide a visual image of the size of apparatus herein described. The paper wound tube 1 of this invention is severed into two tube half portions 2 and 3, being separated along the lines of cut 4 and 5, along the entire heighth of the hogshead, so that when disassembled, the tube moieties may be totally separated from each other, thereby lessening their space requirements and facilitating their transfer particularly when being returned to a distant location after usage. Extending the full heighth of the hogshead 1 are a series of reinforcing staves, as shown at 6, with one of said staves being provided secured just approximate the marginal cut edge of each tube portion for the purpose of essentially providing rigidity at these locations in the hogshead.

As can be seen in said figures, there are a series of fastener means in the catagory of hinge means 7 provided spacedly along the tube length at the location of separation along the tube half portions, and said hinge means are fabricated usually of two hinge parts, as at 8 and 9, (see FIGS. 7 and 8) so that one of each part may be secured to its contiguous reinforcing stave 6 and become a permanent part of a tube half portion. Said hinge parts are formed, as usual, for interdigitation at their central portions, as at 10, having a cylindrical opening provided centrally therethrough their mating parts, so that a pin 11 may be inserted therein for rigidly securing the hinge means together, in addition to their accompanying tube half portions. When arranged in this manner, the assembled tube portions form a cylindrical configuration that approximates the size and dimension for the type of hogshead commonly used in the tobacco industry. The opposite ends of the hinge means 7 are provided with turned ends 12 and 13, which ends are located and designed for embracing or encountering the back or remote edges 14 of their respective staves 6, so as to further insure the retention of the tube portions together, particularly while the hogshead is in use. As has been already described, during tobacco prizing, a hydraulic or other form of ram may insert into its tubular form for exerting tremendous pressures, sometimes in the vicinity of 10,000 pounds per square inch, against the tobacco to cause its high density compression. obviously, any such force has the effect of translating its pressure against the interior walls of the hogshead, and which pressure is further exerted upon the accompanying staves and retaining hinge means as shown in this invention. Thus, the turned ends 12 and 13 of the hinge means of this invention are designed to provide further resistance against any rupture to the separable hogshead along its lines of separation, and to insure its structural integrity during any such procedure.

Figure 3:
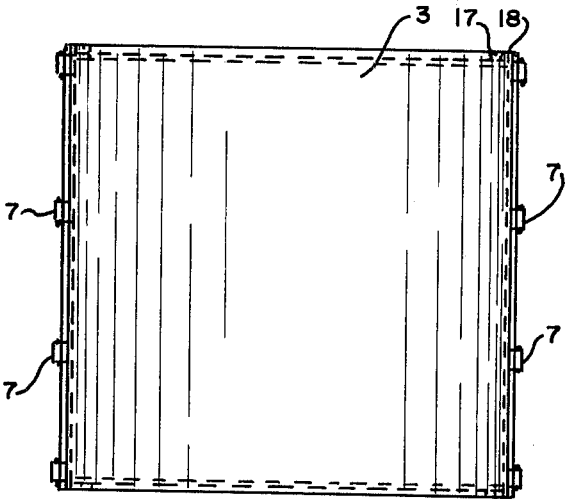
Figure 4:
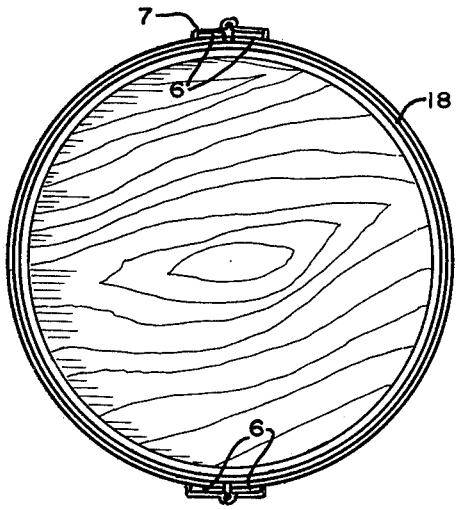
Figure 5:
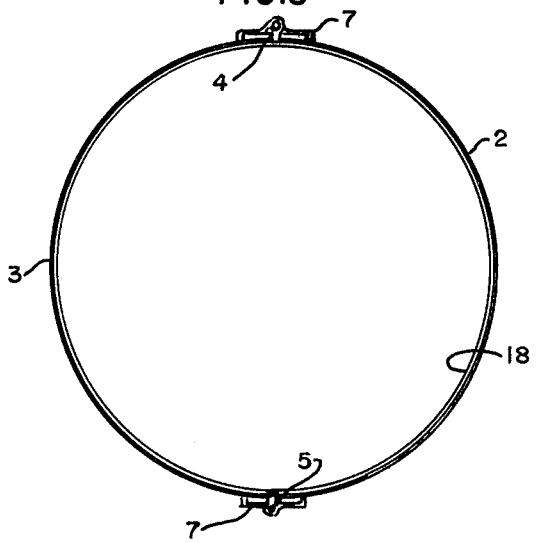

As can also be seen in FIGS. 3 and 5, these lines of separation 4 and 5 of the tube portions 2 and 3 are provided essentially diametrically of each other, meaning that substantially equal sized tube halves are furnished when the hogshead is disassembled.

Figure 6:
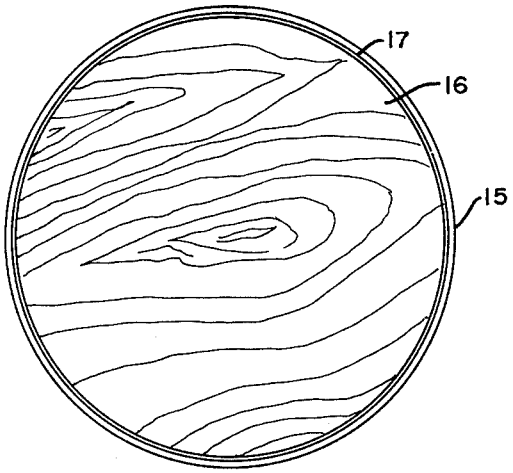

As shown in FIG. 6, one of the end closures 15, and of the type for providnng upper and lower closure to the hogshead, is disclosed. This end closure comprises a cylindrical member 16, which may be formed of wood or even laminated paper or fiberboard as convenient. The shape of the member 16 will be such as to provide its accommodation just within the interior of the assembled tube halves 2 and 3, so as to provide adequate sealing of the hogshead at its upper or lower locations. Being further secured to the one surface of each circular member 16 of the closure is a retaining ring 17, which is disposed slightly inwardly from the outer circumferential periphery of said member 16, to a distance for the following purposes. Provided rigidly within the upper and lower marginal edges of the tube half portions 2 and 3 are a series of semicircular liners 18, and which have a diameter slightly less than the inside diameter of the assembled tube halves, so as to allow for their securement interiorly thereof, but yet have an internal diameter slightly greater than the exterior diameter of the end closure ring 17. Hence, it can be seen that upon installation of an end closure within the assembled hogsheads tube portion 2 and 3, the outer periphery of the circular member of the end closure will rest tightly against the interiorly disposed edge of these liners 18, with their rings 17 being contiguously arranged concentrically inwardly thereof. Hence, the end closures will be snugly fitted and interlocked in place so as to prevent their untimely removal except in a manner as to be hereinafter described. In any event, after the end closures are secured in place, any form of fastening means, such as mail, may be driven through the rings 17 and into the liners 18, so as to further insure closure for the hogshead, as during any rough handling it may encounter while in transit, or during prizing.

Figure 9:
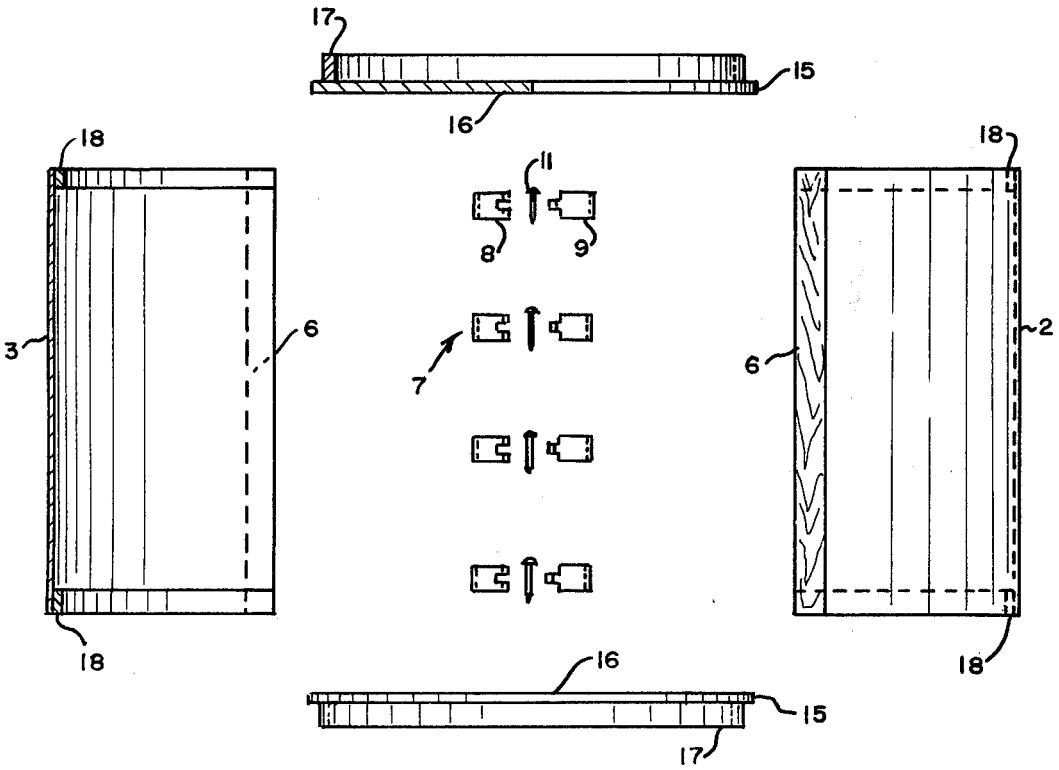

As further shown in FIG. 9, which is an exploded view of the various components formulating the hogshead of this invention, it can be seen that a pair of said end closures are provided for the pair of tube half portions 2 and 3, with a series of hinge parts 8 and 9 designed for fitting upon their respective staves 6 and being secured together by their respective pins 11 for insuring the structural closure for the hogshead particularly during tobacco prizing.

Figure 7:
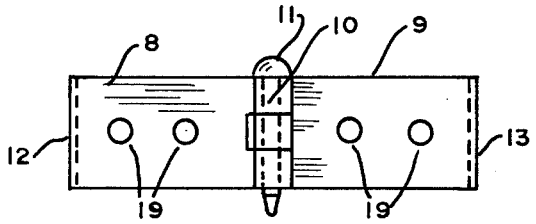
Figure 8:
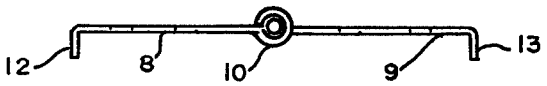

As can also be seen in FIG. 7, there are provided a series of apertures 19 through each hinge part so as to accommodate any form of fastening means, such as a nail or screw, which may be used for securing said parts firmly to their respective staves 6.

In the use of the hogshead of this invention, and upon observing its components as shown in FIG. 9, the assembly of the structure becomes readily apparent. But, it can also be seen that when the tube half portions 2 and 3 of the hogshead are assembled together by means of its hinge means 7, the bottom end closure 15 may be easily inserted into place against its liner 18 for retention thereat, but after an ample quantity of tobacco has been forced into the hogshead, as through its upward opening, the upper end closure 15 must yet be inserted into place. To achieve this the pin 11 of the upper hinge member 7 may be removed, and due to the formation of the tube half portions from the convolutely wound paper, as previously described, these upper sections of the tube halves may be slightly pulled apart, at least a sufficient distance so as to allow the insertion of the upper end closure under its contiguous upper liner 18. Then, the hinge means 7 which has just been disassembled may have its pin 11 inserted once again through its interdigitating segments, and thereby provide complete closure for the hogshead, and in a manner that will not allow its untimely opening until the workman once again forces the pins 11 out of their respective hinges after the tobacco has arrived at its destination.

Figure 10:
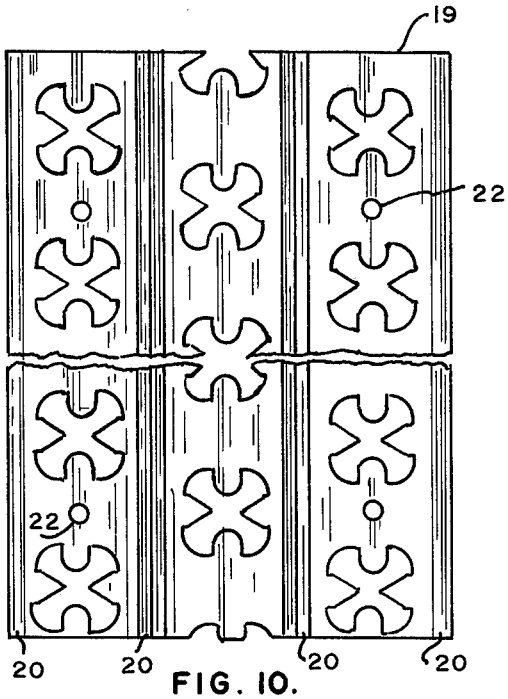
Figure 11:
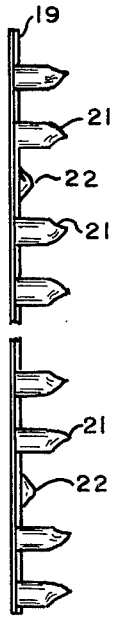
Figure 12:
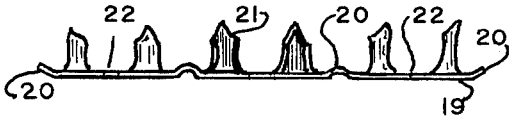

There are various modifications to select components of this invention, and which have been found to work equally as beneficial as the components heretofore describe, and in certain instances, even facilitate and accelerate the assembly or disassembly of the various hogshead components during their fabrication or break down. For example, in FIGS. 10 through 12, there is shown a modified form of stave 19 comprising a metallic strip having a length approximating the heighth of the hogshead, and having formed longitudinally thereof, a series of depressions, as at 20, so as to rigidify the same along its length. Punched from the surface of the shown stave are a series of pointed projections or spikes, as at 21, with the particular configuration of the punched out portions shown in FIG. 10 furnishing four such projections to a group.

Obviously, the main purpose of the aforesaid projections is to furnish a pointed member that may be pressed into the surface of the paperboard tube along its cut edge margins, and therefore, other types or forms of projections punched from the surface of the metallic stave 19 may work just as effectively. A series of apertures, as at 22, are provided through the stave and correspond to the apertures, as at 19, provided in the hinge means 7, so that any form of fastening means may extend therethrough and be secured to the papertube. In addition, the outer depressions 20 along the length of the metallic stave are of sufficient thickness to provide for the contact and engagement of the turned ends 12 and 13 of the hinge means 7, so that further retention of the hinge means may be provided after it has been fastened to the papertubes of the hogshead.

Figure 15:
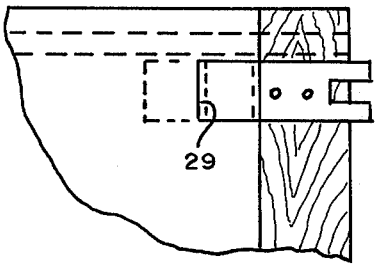
Figure 13:
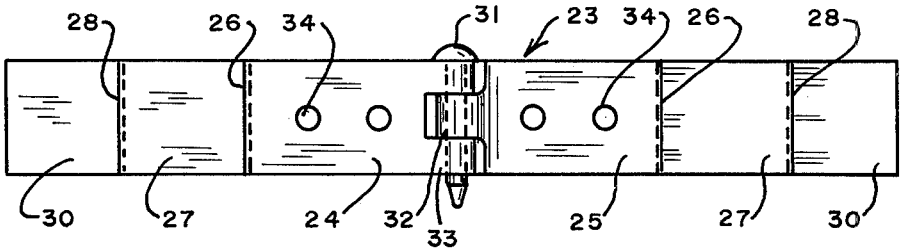
Figure 14:
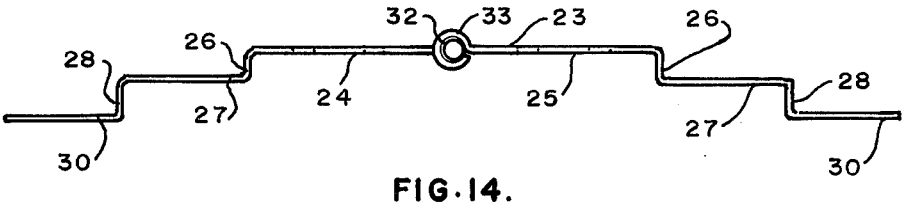

A further modification in the style of hinge means utilized in the teachings of this invention is shown in FIGS. 13 and 14, with one part of said hinge means being shown in its stallation in FIG. 15. Said hinge means 23 comprises a pair of hinge parts 24 and 25, which are initially bent, as at 26, to provide the turned end portions that are useful for embracing against the remote edges of the staves, as previously analyzed. Furthermore, each hinge part is then provided with an integral extension, as at 27, and which is disposed for laying contiguously against the outer surface of their respective tube half portions. In addition, a further bend is made to each hinge part at 28, and said bend is of sufficient width to provide for the disposition of this hinge portion through apertures, as at 29, formed through the surface of each tube half portion. Then, an additional integral extending and bent portion 30 is provided at the end of each hinge part, and these portions 30 are designed for lying contiguously against the interior surface of their respective tube half portions. Hence, it can be seen through this arrangement, that a double retention in the installation of the hinge means to the hogshead is provided, whereby the first turned end 26 of each hinge will embrace against the remote edges of their respective staves, while the second turned portions 28 are designed for embracing against the apertures 29 formed through each tube half portion of the hogshead. Installation of a hinge means of this type can simply be achieved by removal of its pin 31, and then the insertion of each end portion 30 of the respective hinge parts through the apertures provided in their respective tube half portions, and upon insertion of the ends 30 each hinge part may be turned so as to dispose the turned portions 28 in the said apertures, thereby bringing the surface of the hinge parts 27 against the outer surface of the tube half portions, while the surfaces 24 and 25 of each hinge part comes to rest against the surface of the hogshead staves. When this is achieved, the interdigitating portions 32 and 33 should be aligned thereby providing for the insertion of the pin 31 therethrough for retention of the tube moieties together. Obviously, the series of hinge means provided along the heighth of the tube half portions, where they come together, may be constructed in this manner, and their retention to the hogshead may be achieved through their insertion through the apertures of the two portions as just described, with the pin 31 securing their retention together. Hence, upon removal of any pin 31, each hinge part may then be pivoted outwardly to facilitate their removal from the hogshead parts. On the other hand, where further securement of the hinge parts to the hogshead is desired, any form of fastener may be inserted through a series of apertures 34 provided in the hinge and then secured to either their underlying staves or into the papertube portions themselves.

Figure 16:
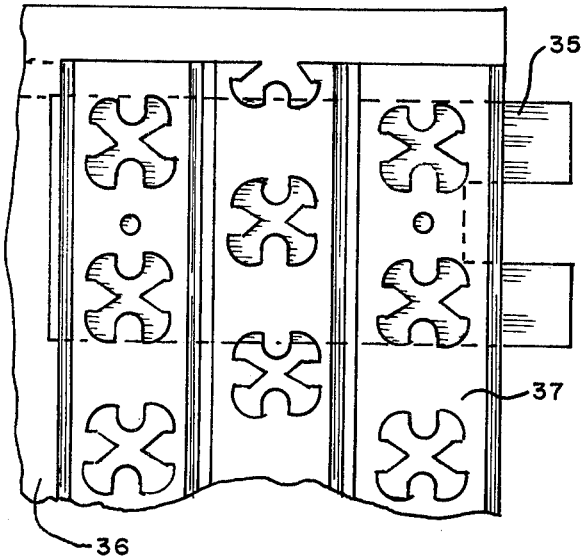
Figure 17:
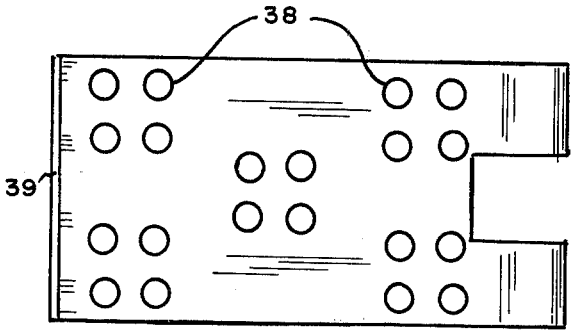
Figure 18:
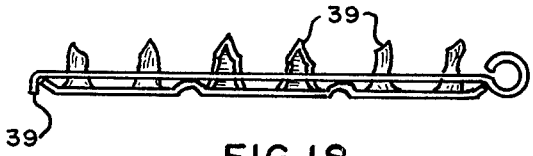

A further modification in the method for assembling the fastener means, or hinge part, 35 to its respective tube half portion 36 is shown in FIGS. 16 through 18. In this arrangement, the hinge part 35 is disposed intermediate the metallic stave 37, and the hinge part itself includes a series of patterned apertures, as of 38, so as to accommodate the insertion therethrough of the integral pointed tabs 39 of the stave before their embedment into the paper tube portion 36. Hence, it can be seen that the hinge parts, in addition to the metallic staves, can be applied to each tube moiety in a one step operation, by simply fitting the hinge part upon the stave tabs, and the pressure applying the metallic staves to their respective portions of the hogshead. In addition, each tube part may further include, if it is deemed essential, a turned out end portion 39 that is disposed for embracing the remote or back edge of the metallic stave so as to further insure the retention of the hinge upon the stave, and act against a bending of the stave tabs as when excessive hydraulic pressures are being applied during tobacco prizing.

Figure 19:
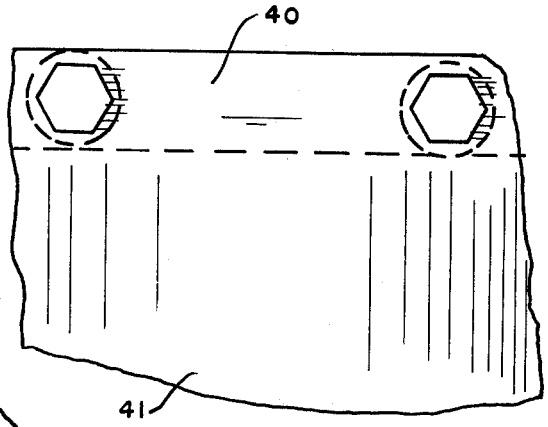
Figure 20:
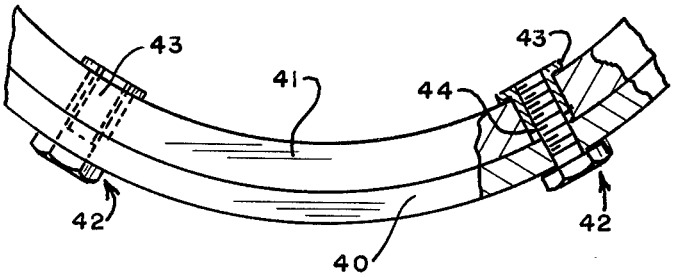

A further modification to the application of the liners, one as shown at 40, to it tube portion 41 is shown in FIGS. 19 and 20. In this particular arrangement, the liner is of the replaceable type that can be removed from its hoghead tube portion and be replaced in the event that it becomes damaged as through sustained usuage. The style of fastening member that might be utilized for securing this replaceable liner to the hogshead may comprise a series of bolt and nut combinations, as at 42, inserted through a series of apertures provided aligned through each liner and contiguous tube portion. In addition, the nut segment 43 of each combination may be formed as a T-nut, with said nut fitting within an enlarged counterbore, as at 44, provided through the liner, and having its integral upper flange securing against the inner surface of the liner to insure its firm retention in place. In this manner, the bolt and T-nut combinations 42 may be easily opened and removed as when it is desired to replace a liner from the hogshead. As previously analyzed, these liners may be formed of wood, or even from other wound paper tubes cut segmentally into liner configurations, and they all may be predrilled at predesigned locations for accomodating, rather universally, the insertion of the fasteners 42 therethrough.

Obviously, as previously analyzed, due to the convolutely wound configuration of the paper tube formed for use in this invention, the tubes may preferably be designed circular in shape, as shown in the drawings of this invention, or they may even be prepared in noncircular shapes, or even to the rectangular shape, depending upon the surface configuration of the mandrel utilized in the winding process and the type of hogshead desired. The convolute winding of tubes in this manner make it feasible for the formation of the tubes other than the circular shape, a feature that cannot be achieved through the use of spiral winding techniques.

Other modifications to the invention as disclosed herein may be considered by those skilled in the art upon reviewing the teachings described in this application. Such modifications, if encompassed within the spirit and scope of the accompanying claims, are intended to be protected by any patent to issue hereon. The description of the preferred embodiment is done for illustration purposes only, and not for limiting the scope of protection sought for the invention described and analyzed herein.

Having thus described the invention, what is claimed and desired to be secured by Letters Patent is:

1. A hogshead formed from a wound paper tube and of the type designed for holding a quantity of prized tobacco during its transit and storage, and being collapsible to facilitate its component return for reuse, said paper tube being formed of convolutely wound paper and to a thickness to provide for its strucutral integrity even when encountering the forces of tobacco prizing, the paper tube of each hogshead being cut into complemental half portions, a series of reinforcing staves, each stave having a length approximating the heighth of tube half portions with one of said staves being adhered to each outer marginal cut edge of a tube half portion, means fastening each stave to the contiguous portion, a series of hinge means fastening to the staves and cooperating with pin means for retaining the tube halves together, a pair of retaining liners, one of each liner adhering to the upper and lower marginal edges of each tube half portion, said liners also being cut to correspond the dimensions of each tube half portion, upper and lower end closures having dimensions corresponding to the inner dimensions of the assembled tube halves and being retained inwardly of the respective retaining liners to secure the hogshead into closure, each hinge means including a pair of hinge parts, said parts being held together by means of said pin means with one of each part being secured to one of the adjacent reinforcing staves, and each hinge means part having a turned end for holding against the remote edge of its proximate stave for insuring the retention of the hogshead into closure during tobacco compression.

2. The invention of claim 1 wherein there are a series of said hinge pairs provided spacedly along the heighth of the hogshead and adjacent the edges of the complemental tube half portions.

3. The invention of claim 2 wherein said papertube forming the complemental halves of the hogshead is cylindrical in configuration.

4. The invention of claim 2 wherein said papertube forming the complemental halves of the hogshead is non-circular in configuration.

5. The invention of claim 3 wherein said reinforcing staves of the hogshead are formed of wood, and fastening means securing said wood staves to their respective marginal edges of the cut tube.

6. The invention of claim 3 wherein said reinforcing staves of the hogshead are formed of metal, and fastening means securing said metal staves to their respective marginal edges of the cut tube.

7. The invention of claim 6 wherein said fastening means are integrally formed with their respective staves.

8. The invention of claim 7 wherein said fastening means comprises press formed tabs projecting from one surface of the stave and being pointed to facilitate their embedment into the paper wound tube.

9. The invention of claim 3 wherein each end closure comprises the circular member having dimensions corresponding to the inner dimension of the assembled tube halves, a ring having an outside diameter slightly less than the interior diameter of the pair of retaining liners when the tube halves are assembled, said ring being affixed to one side of the circular member, said closure ring being arranged concentrically within the contiguous retaining liners when its end closure is fitted within the assembled hogshead.

10. The invention of claim 9 and including fastening means securing the ring of each end closure to its contiguous retaining liners in the assembled hogshead.

11. The invention of claim 2 wherein each tube half portion has an aperture provided near the location where a turned end of a hinge part is disposed, said hinge part integrally extending beyond its turned end for extension into the tube portion through its aperture, said hinge part being further bent interiorly of the tube portion to dispose a part of its hinge contiguous the inner surface of the tube.

12. The invention of claim 11 wherein the further bent portion of said hinge extends circumferentially away from the exteriorly arranged portion of the hinge part.

13. The invention of claim 11 wherein said hinge parts are releasible from their respective tube half portions.

14. The invention of claim 1 wherein said liners are removable from their adherence to the tube portions, and removable fastening means securing said liners to said tube portions.

15. The invention of claim 14 and wherein said fastening means includes bolt and nut combinations being inserted through the liners and contiguous tube portions to secure the same together.

16. The invention of claim 15 wherein the nut of the fastening means comprises a T-nut, and said liner being counterbored for accommodating the insertion of the T-nut therein.

17. The invention of claim 8 wherein the hinge means are disposed intermediate the stave and its contiguous tube half portion, said hinge means having patterned apertures therein to accommodate the insertion of the pointed tabs therethrough prior to their embedment into the paper wound tube.

18. The invention of claim 17 wherein each hinge means turned end is provided for holding against the edge of its proximate stave.

19. A hogshead formed from a wound paper tube and of the type designed for holding a quantity of prized tobacco during its transit and storage, and being collapsible to facilitate its component return for reuse, said paper tube being formed of convolutely wound paper and to a thickness to provide for its structural integrity even when encountering the forces of tobacco prizing, the paper tube of each hogshead being cut into complemental half portions, a series of reinforcing staves, each stave having a length approximating the heighth of the tube half portions with one of said staves being adhered to each outer marginal cut edge of a tube half portion, means fastening each stave to the contiguous portion, a series of fastener means fixed to the staves and cooperating to retain the tube halves together, a pair of retainer liners, one of each liner adhering to the upper and lower inner marginal edges of the tube half portions, said liners also being cut to correspond to the dimensions of each tube half portion, upper and lower end closures having dimensions corresponding to the inner dimensions of the assembled tube halves and being retained inwardly of the respective retaining liners to secure the hogshead into closure, there being a series of said fastener means provided spacedly along the heighth of the hogshead and adjacent the edges of the complemental tube half portions, said reinforcing staves of the hogshead being formed of metal, means for securing said metal staves to their respective marginal edges of the cut tube, said means comprising integral tabs projecting from one surface of the metal stave and being pointed to facilitate their embedment into the paper wound tube, said tube portion fastener means being disposed intermediate a stave and its contiguous tube half portion, said fastener means having patterned apertures therein to accommodate insertion of the pointed tabs therethrough prior to their embedment into the paper wound tube, and each fastener means having a turned end for holding against the remote edge of its proximate staue for insuring the retention of the hogshead into closure during tobacco compression.

* * * * *